United States Patent [19]

Mojden

[11] Patent Number: 5,005,340

[45] Date of Patent: Apr. 9, 1991

[54] APPARATUS FOR INSPECTING AND PACKAGING CAN ENDS

[75] Inventor: Andrew E. Mojden, Hinsdale, Ill.

[73] Assignee: Fleetwood Systems, Inc., Countryside, Ill.

[21] Appl. No.: 454,153

[22] Filed: Dec. 21, 1989

[51] Int. Cl.[5] ..... B65B 57/20

[52] U.S. Cl. ..... 53/500; 53/254; 53/532; 53/542; 414/798.5

[58] Field of Search ..... 53/500, 498, 532, 542, 53/254; 414/798.5, 901

[56] References Cited

U.S. PATENT DOCUMENTS

| | | | |
|---|---|---|---|
| 3,503,486 | 3/1970 | Alexander et al. | 414/798.5 |
| 3,827,582 | 8/1974 | Lederer | 414/798.5 |
| 3,878,945 | 4/1975 | Mojden et al. | 214/7 |
| 3,962,845 | 6/1976 | Mojden et al. | 53/500 X |
| 4,391,560 | 7/1983 | Fardin | 53/532 X |
| 4,742,669 | 5/1988 | Mojden | 53/500 |
| 4,776,149 | 10/1988 | Ter Horst | 53/532 X |
| 4,848,059 | 7/1989 | Müller et al. | 53/532 X |

*Primary Examiner*—James F. Coan
*Attorney, Agent, or Firm*—Richard A. Giangiorgi

[57] ABSTRACT

An improvement is provided in an article handling apparatus capable of receiving a continuous flow of articles such as can ends and automatically counting and separating a stack of articles of a prescribed number disposed in a facewise stacked relation for delivery to a packing station or the like. The apparatus comprises an elongate trough for handling a plurality of can ends in stacked, facewise engagement, a counting arrangement for counting the number of can ends passing a predesignated location up to a predetermined number, and a mechanism for separating this predetermined number from the flow of articles upon the counting thereof and transporting the articles from said counting station. The improvement comprises an inspection station located between the counting station and the packing station, and including apparatus for rotating the articles to permit visual inspection thereof, and apparatus for transporting the articles, following visual inspection thereof, from the inspection station to the packing station.

11 Claims, 4 Drawing Sheets

APPARATUS FOR INSPECTING AND PACKAGING CAN ENDS

BACKGROUND OF THE INVENTION

The present invention relates generally to article handling apparatus and more specifically to apparatus capable of receiving a flow of articles such as can ends and inspecting and delivering a stack or group of accurately precounted articles such as can ends to a packaging station for manual or automatic packaging, such as bagging.

Generally speaking, can manufacturers fabricate can bodies and can ends for sale to canning operations, beverage packaging operations or the like wherein the product to be packaged is introduced into the can body and sealed therein by securing to the open end thereof a mating can end. Generally speaking, the can bodies and can ends are separately provided and packaged for use by the end user. In practice, the can ends are usually shipped in elongated kraft paper bags, each of which contains a given predetermined number of can ends in a facewise stacked or "nested" arrangement. While the number of can ends in each bagged package may vary from manufacturer to manufacturer or from customer to customer, it is preferable that an accurate count of can ends be maintained in each bag. In this way, regardless of the size of the bag, an accurate count of the can ends delivered and can ends on hand can be readily determined. Since the number of can ends normally delivered and ordered run into the millions, any manual handling for counting and inspection of the can ends is, of course, impractical. Can manufacturers employ various methods of providing the desired count of can ends in each bag, and of inspecting the ends prior to bagging to remove defective ends.

While heretofore the handling and bagging of can ends was largely a manual operation, it will be appreciated that this older method produces exceedingly high labor costs. Accordingly, it is desirable to mechanize and automate the handling, counting, inspecting and bagging of can ends insofar as can be done, to minimize the associated labor costs. Moreover, with present high-speed can manufacturing lines, manual bagging operations create an effective bottleneck in the process, which can be alleviated only by the employment of a relatively large number of operators in the counting, inspection and bagging area. This also requires additional operators and diverting machinery for diverting the can ends from the processing machine to the various bagging stations This additional machinery and operators further increase operating costs.

All of the foregoing factors additionally point to a need for automation of the counting, inspecting and bagging process. Our prior U.S. Pat. Nos. 3,878,945 and 4,742,669 present a method and apparatus for counting and packaging can ends and a can end counting system, respectively, which overcome many of the foregoing problems and substantially automate important portions of the counting, inspecting and packaging process. However, there remains room for further improvement.

OBJECTS AND SUMMARY OF THE INVENTION

Accordingly, it is a general object of this invention to provide an improved apparatus for inspection and packaging of can ends. Briefly, and in accordance with the foregoing, the invention presents an improvement in an article handling apparatus capable of receiving a continuous flow of articles such as can ends and automatically counting and separating a stack of articles of a prescribed number disposed in a facewise stacked relation for delivery to a packing station or the like, said apparatus comprising an elongate trough for handling a plurality of can ends in said stacked facewise engagement, means for counting the number of can ends passing a predesignated location up to said predetermined number, and means for separating said predetermined number from said flow of articles upon the counting thereof and transporting the articles from said counting station. The improvement comprises an inspection station located between said counting station and said packing station, and includes means for rotating said articles to permit the operator to conduct a visual inspection thereof prior to packaging, and transport means for transporting said articles, following said visual inspection thereof, from said inspection station to said packing station.

BRIEF DESCRIPTION OF THE DRAWINGS

The features of the present invention which are believed to be novel are set forth with particularity in the appended claims. The organization and manner of the operation of the invention, together with further objects and advantages thereof may best be understood by reference to the following description, taken in connection with the accompanying drawing in which like reference numerals identify like elements, and in which:

DETAILED DESCRIPTION OF THE ILLUSTRATED EMBODIMENT

Figure 1:
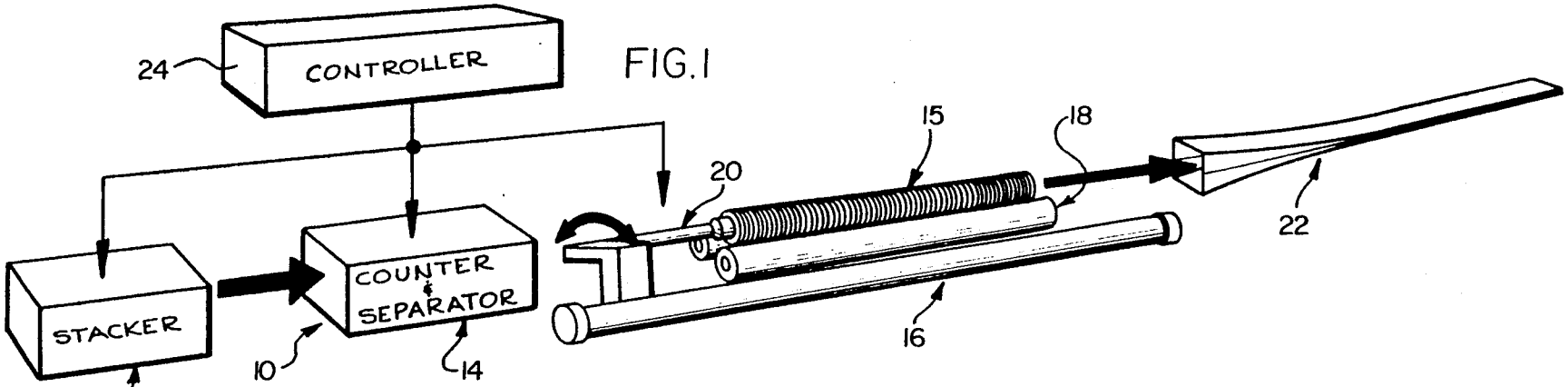
FIG. 1 is a diagrammatic view of a can end stacking, counting, inspecting and packaging apparatus in connection with which the present invention may advantageously be utilized.

Referring to the drawings, and initially to FIG. 1, an article handling apparatus of the type with which the invention may advantageously be utilized is shown in a somewhat functional, diagrammatic form. This article handling apparatus 10 is capable of receiving a continuous flow of articles such as can ends, disposed in a nested or facewise stacked condition, and automatically counting and separating a group 15 of these articles of a prescribed or predetermined number for delivery to a packing station or the like.

The article handling apparatus 10 includes a receiving end or station at which is located a stacking apparatus or stacker 12 for receiving a flow of articles such as can ends and stacking the same into a facewise stacked or nested condition. Following the stacker 12 is a counting and separating station 14 including counting means, which counts the number of articles passing a predesignated location, and separating means for separating a group or stack 15 of articles of the prescribed or predetermined number. Generally speaking, this prescribed number of articles is that number which is packaged for delivery to an end user. Can ends are customarily packaged in kraft paper bags in groups or so-called "sticks", each containing some preselected number of can ends, which may be from on the order of 100 up to 300 per stick. This number is generally determined by the customer or end user. Accordingly, the counter and separator includes both counting means and separating means for counting and separating such stacks or so-called "sticks" of articles for packaging or bagging.

In accordance with the invention, following the counter and separator 14 is an inspection station 16, which a counted and separated stack of articles traverses, for visually inspecting the same prior to the packaging thereof. The inspection station 16 includes a rotating assembly or rotating means 18, which engages and rotates the group 15 of articles to permit visual inspection thereof, and transport means 20 for engaging the articles in the inspection station 16, following the rotation and inspection thereof, and for advancing the group of articles to a packaging station 22.

A controller, or control means 24 is also operatively coupled with the counting and separating means, with the roller means and with the transport means for controlling a predetermined sequence of operation thereof. In this sequence of operation, the articles are, in order, automatically counted, separated, inspected and transported to the packaging stations in groups of facewise stacked or nested articles of the predetermined or prescribed number in an automated and continuously repeating fashion This sequencing is such that as one group 15 of the articles is advanced to the packaging station 22, a subsequent or following group is advanced to the inspection station and a still next subsequent or following group is being counted at the counting station.

Referring now to the remaining figures of drawings, details of an inspection station, including rotating means and transport means in accordance with a preferred embodiment of the invention will be described in further detail.

Figure 2:
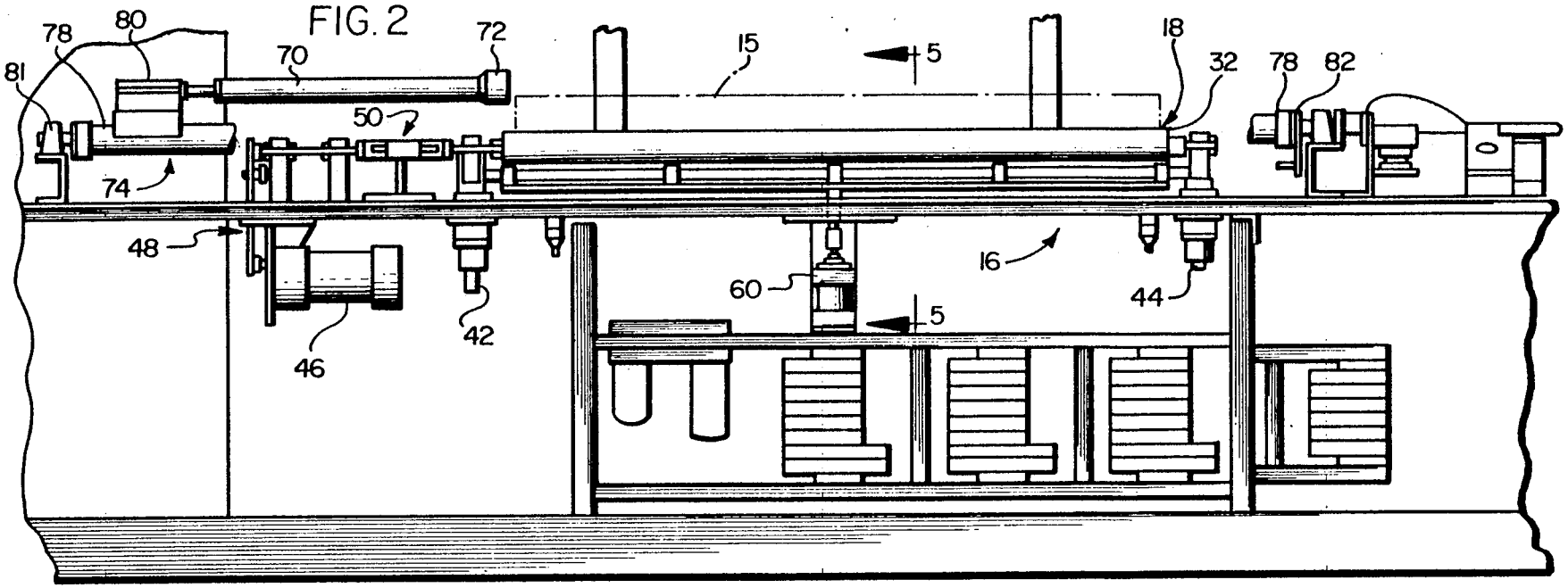
FIG. 2 is a partial side elevation of an inspection station and bagging station of the apparatus of FIG. 1, in accordance with the invention.
Figure 3:
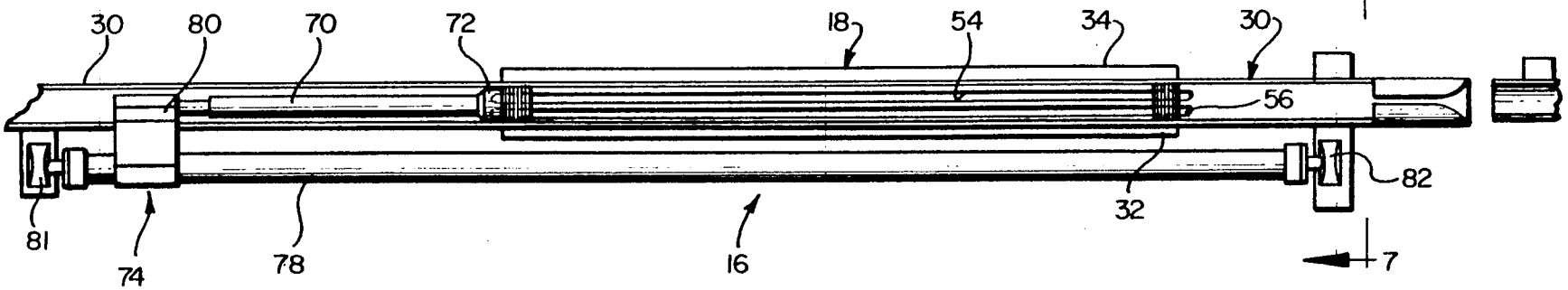
FIG. 3 is a top plan view of the apparatus of FIG. 2.

Referring initially to FIGS. 2 and 3, it should be understood that the articles or can ends are generally transported throughout the article handling apparatus by an elongate trough or trough means 30 (see FIG. 3) which extends from the receiving end of the article handling apparatus at stacker 12 to and including the article bagging or packaging station 22. The trough is suitably dimensioned for partially surroundingly engaging substantially one-half of the peripheries of articles of a generally circular peripheral configuration such as can ends. Further means, such as elastomeric strips (not shown) which extend the length of the trough 30 are also preferably utilized for maintaining the articles in an upright and nested condition as they travel therealong. Such strips are shown, for example, in our above-referenced U.S. Pat. No 4,742,669 to which reference is invited.

Figure 4:
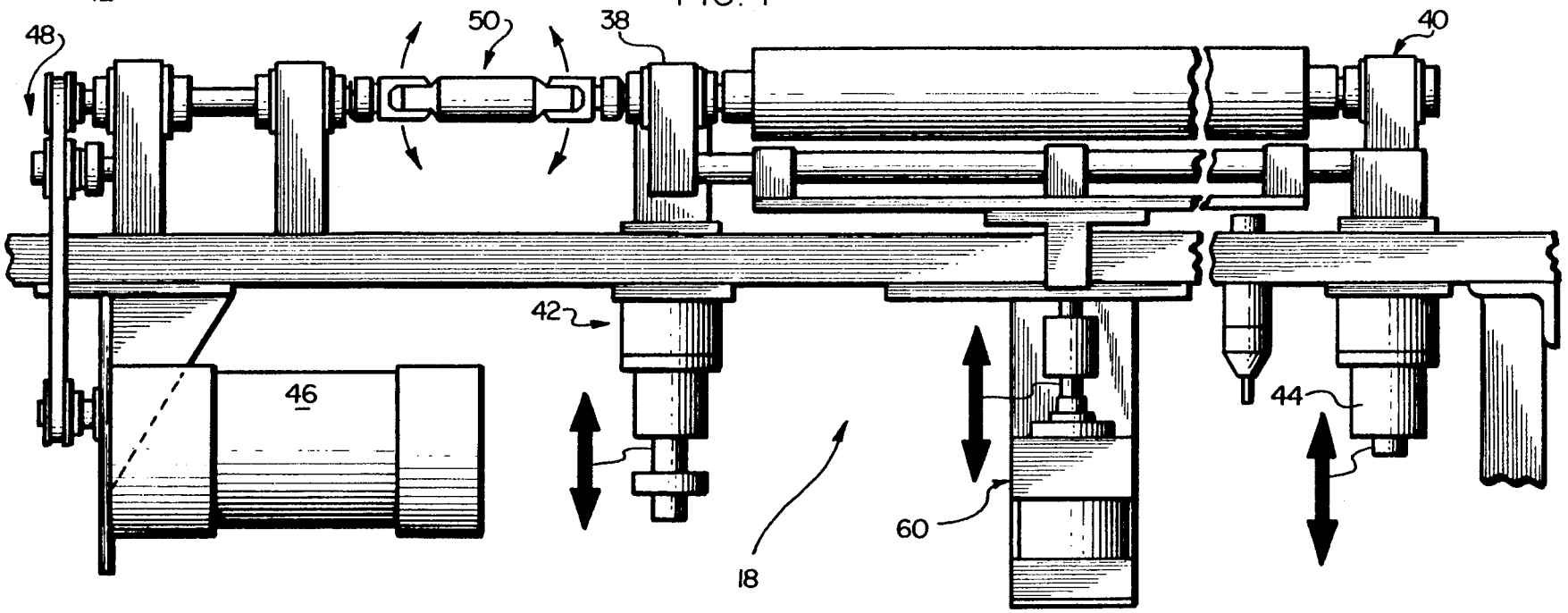
FIG. 4 is an enlarged side elevational view, partially broken away, showing further details of a can end rotation apparatus in accordance with the invention, useful at the inspection station of the apparatus of FIG. 1.
Figure 6:
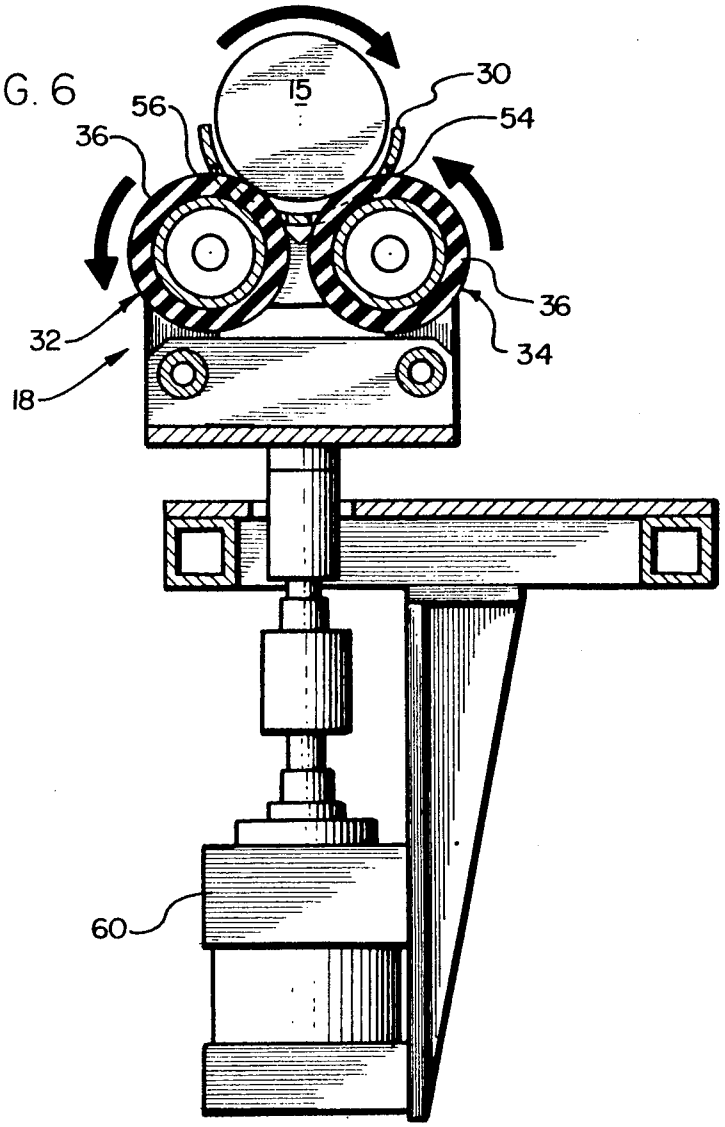
FIG. 6 is a view similar to FIG. 5, and showing a moved position.
Figure 5:
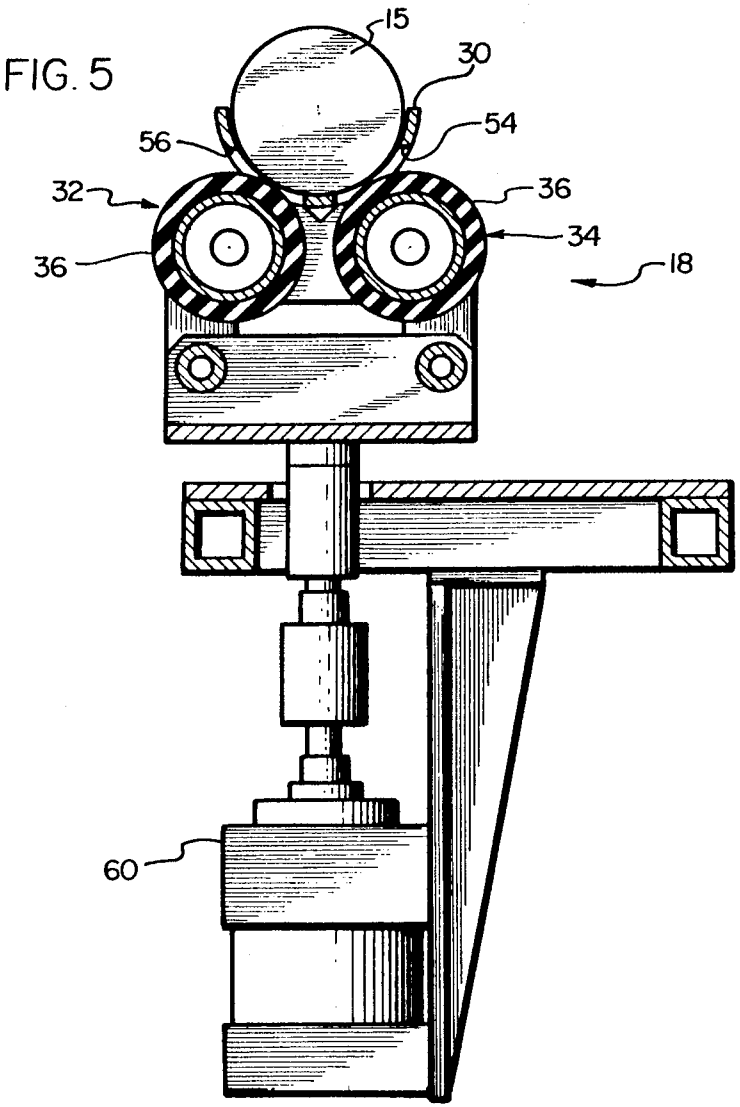
FIG. 5 is a partial sectional view taken generally along the line 5—5 of FIG. 4.

The portion of the trough or trough means 30 which extends through the inspection station 16, is configured with through elongate slots 54, 56 for receiving peripheral surface portions of a pair of elongate rollers 32, 34 which comprise the roller means 18 therethrough to rotate the can ends 15 for inspection. As also shown in FIGS. 4–6, these elongate rollers are provided with article-contacting surfaces 36 of an elastomeric material such as a rubber or rubber-like substance.

The rollers are rotatably mounted in bearing block means or assemblies 38, 40 at their opposite axial ends, which bearing block means are further mounted in respectively slidably movable assemblies 42, 44 for radially moving the same relative to the axis of the trough means 30. This movement is sufficient to permit the rollers to retract and advance relative to the openings 54, 56 in the trough 30, as indicated respectively in FIGS. 5 and 6. In order to advance and retract the rollers as described, there is provided a piston-and-cylinder arrangement or assembly 60 at a mid-portion thereof.

This piston-and-cylinder assembly acts to advance or retract the entire roller assembly, which is slidably mounted on the slidable bearings or blocks 42, 44 at or near its respective axial ends.

A motor or motor means 46 is also connected by way of a drive train or drive means generally designated by reference numeral 48 for rotating the rollers 32, 34 in unison, for rotating the can ends 15 to permit visual inspection thereof at the inspection station 16. The drive train or drive means further includes a flexible connector means 50, which is sufficiently flexible in a generally radial direction to permit the desired degree of radial movement of the rollers relative to the trough means for advancing or retracting the same relative to the can ends 15. It will be noted that the flexible couplings 50, which are provided for each of the rollers 32, 34, permit sufficient movement in this manner to avoid any stress or the necessity of any movement with respect to the interconnected drive belt and sheave components indicated generally at reference numeral 48.

Figure 7:
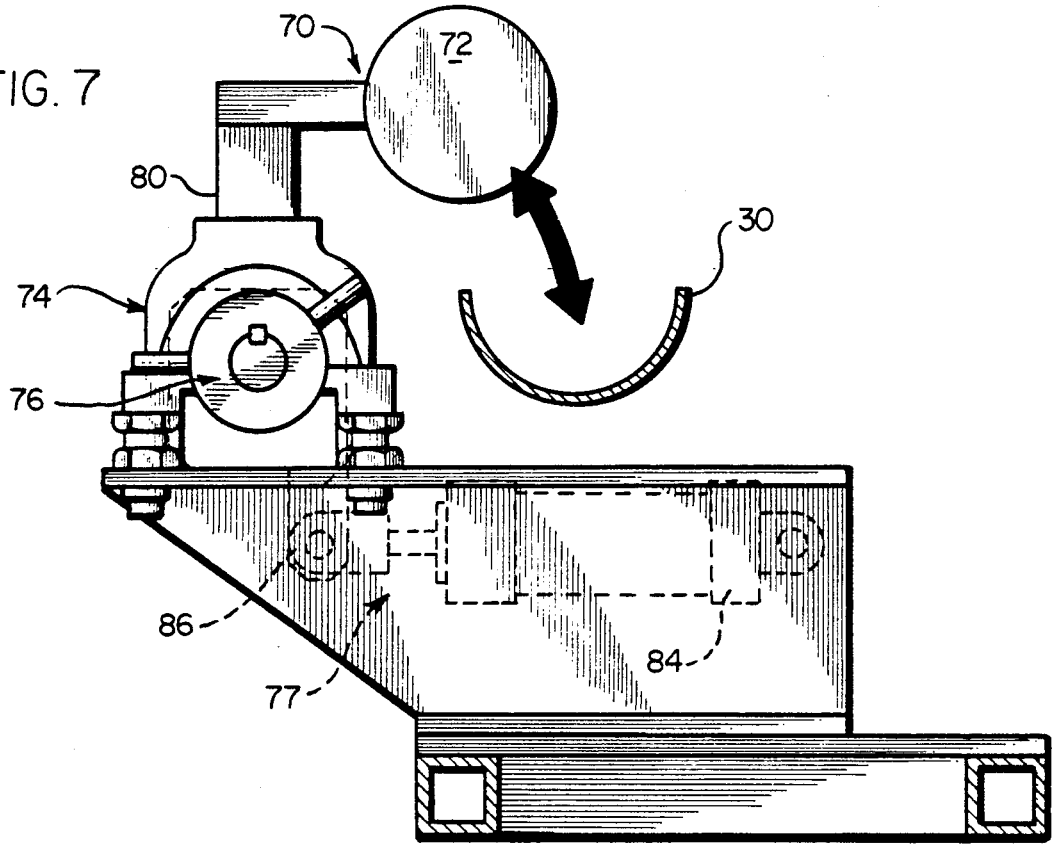
FIG. 7 is a partial sectional view taken generally along the lines 7—7 of FIG. 3.
Figure 8:
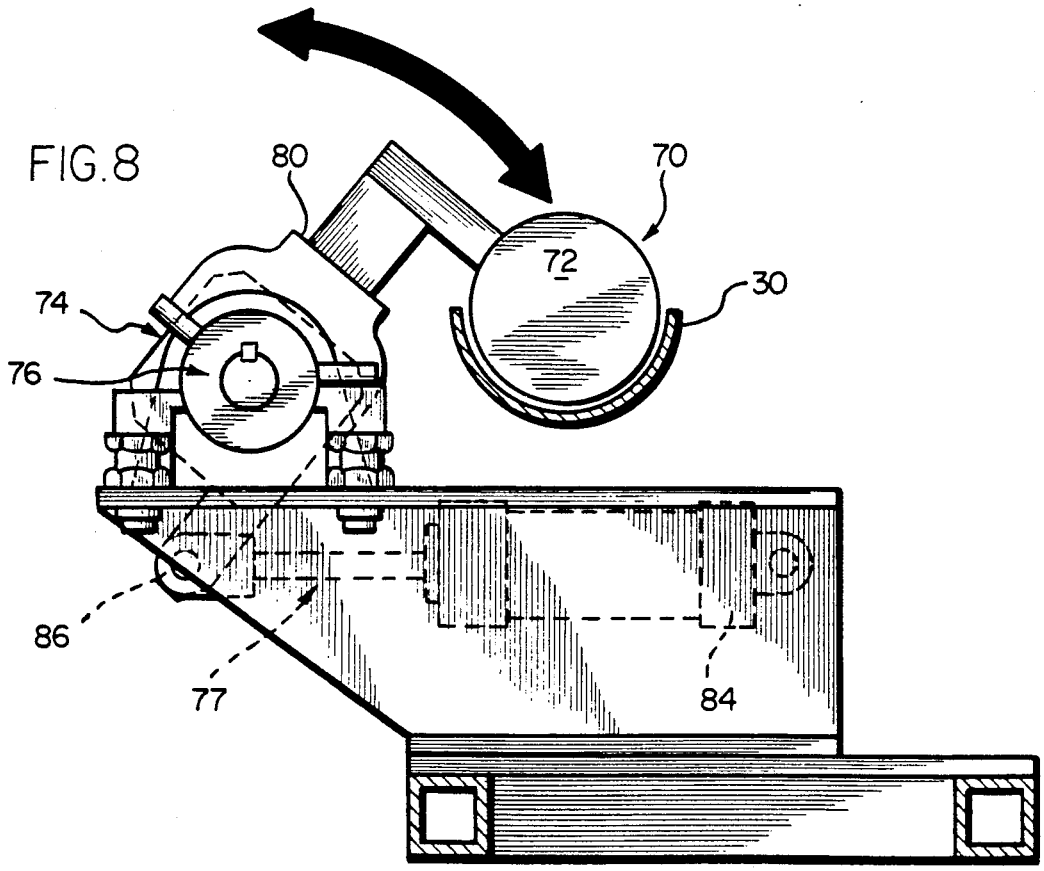
FIG. 8 is a view similar to FIG. 7 and illustrating a moved position.

Referring now also to FIGS. 7 and 8, some further details of the transport assembly in accordance with the invention will be described. The transport means or assembly includes a push-rod member 70, having a cushioned end 72 for directly contacting and pushing the can ends along the trough 30 at least from the inspection station 16 to the bagging or packaging station 22. As best viewed in FIGS. 3 and 8, the push-rod is dimensioned and configured for being axially slidably received within the trough 30 during this operation. However, as best viewed in FIGS. 2 and 7, the push-rod is also completely retractable relative to the trough for permitting the flow of can ends into the inspection station from the preceding counting and separating station. Generally speaking, this advancement of articles is accomplished by a separator or separating means which may take the form shown in our prior U.S. Pat. No. 3,878,945, to which reference is also invited.

To accomplish the foregoing operations, the transport means also includes carriage means 74 and pivotal mounting means 76 for mounting the carriage means in an orientation generally parallel to the trough 30 and operation means 77 for bidirectionally pivoting the carriage means to the extent necessary to cause the push-rod 70 to enter the trough to engage and advance the can ends and to otherwise swing free of the trough to permit free movement of subsequent groups of can ends into the inspection station. In the illustrated embodiment, this carriage means 74 includes an elongate cylinder member 78 which extends generally parallel with and spaced apart from the trough 30 at the inspection station, and a connecting yoke member or yoke means 80. Yoke 80 is movable by the cylinder 78 bidirectionally along the length thereof, and also mounts the push-rod 70 bidirectionally therewith for engaging the trailing end of a stack or group 15 of can ends in the inspection station and advancing the same into the packaging station for bagging or packaging of the same.

The pivotal mounting means 76 mounts the cylinder 78 for pivotal or rotational motion relative to the trough so as to pivot the push-rod into and out of the trough. The pivotal mounting means include a pair of bearing blocks 81, 82 which rotatably journal cylinder 78 at axial ends thereof. Operating means 77 takes the form of a piston-and-cylinder 84, which is mounted transversely to the elongate cylinder 78 and which is provided with a suitable linkage arrangement 86 for pivoting or rotating the cylinder in the desired fashion to obtain the desired motion of push-rod 70 into and out of trough 30. The operating means 77 and cylinder 78 are responsive to the previously described control means 24 for operating the pivotal mounting means 76 in a controlled sequence. This sequence is such that the push-rod 70 enters the trough following the rotation of the can ends or other articles for inspection, whereupon the push-rod is advanced along the carriage 74 to advance the inspected group of articles into the packaging station for packaging. The sequence is such that operating means 77 thereafter pivots the push-rod out of the trough and cylinder 78 returns the push-rod along the carriage in preparation for advancement of a further group of articles from the inspection station to the packaging station.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

I claim:

1. Article handling apparatus for handling articles such as can ends, said apparatus being capable of receiving a continuous flow of said articles and automatically counting and separating a group of said articles of a prescribed number, disposed in a nested condition for delivery to a packing station, said apparatus comprising: elongate trough means for handling a plurality of said articles in a nested condition; transport means for advancing said articles longitudinally of the trough means; an inspection station including article rotating means for rotating said articles within said trough means to permit visual inspection of the same prior to advancement to said packing station and control means for controlling a sequence of operation of said articles rotating means and of said transport means for initially causing said article rotating means to rotate said articles for inspection, and thereafter for activating said transport means to transport the articles out of said inspection station and into said packing station; wherein said transport means comprises push-rod means dimensioned for entering into said trough means for directing contacting and pushing said articles therethrough, at least from said inspection station into said packing station, carriage means for bidirectionally moving said push-rod means relative to the longitudinal dimension of said trough means, and pivotal mounting means for mounting said carriage means in an orientation generally parallel to said trough means, and for bidirectionally pivoting the same to the extent necessary to cause said push-rod means to enter the trough means to engage and advance said articles and to otherwise swing free of the trough means to permit the free movement of a subsequent group of articles into the inspection station; and wherein said carriage means comprises an elongate cylinder member which extends generally in parallel to said trough means at said inspection station, and yoke means movable by said cylinder means bidirectionally along the length thereof for mounting said push-rod means.

2. Article handling apparatus for handling articles such as can ends, said apparatus being capable of receiving a continuous flow of said articles and automatically counting and separating a group of said articles of a prescribed number, disposed in a nested condition for delivery to a packing station, said apparatus comprising: elongate trough means for handling a plurality of said articles in a nested condition; transport means for advancing said articles longitudinally of the trough means; an inspection station including article rotating means for rotating said articles within said trough means to permit visual inspection of the same prior to advancement to said packing station and control means for controlling a sequence of operation of said article rotating means and of said transport means for initially causing said article rotating means to rotate said articles for inspection, and thereafter for activating said transport means to transport the articles out of said inspection station and into said packing station; wherein said rotating means comprises a pair of elongate rollers substantially similar in length to the length of said group of articles of a prescribed number in nested condition, mounting means for mounting said rollers to advance and retract relative to said trough means upon command, and openings in said trough means for accommodating at least a portion of said roller means therethrough for contacting and rotating said articles.

3. Apparatus according to claim 2 wherein said transport means comprises push-rod means dimensioned for entering into said trough means for directly contacting and pushing said articles therethrough, at least from said inspection station into said packing station, carriage means for bidirectionally moving said push-rod means relative to the longitudinal dimension of said trough means, and pivotal mounting means for mounting said carriage means in an orientation generally parallel to said trough means, and for bidirectionally pivoting the same to the extent necessary to cause said push-rod means to enter the trough means to engage and advance said articles and to otherwise swing free of the trough means to permit the free movement of a subsequent group of articles into the inspection station.

4. Apparatus according to claim 3 and further including means responsive to said control means for operating said pivotal mounting means in said controlled sequence for causing the push-rod means to enter the trough means following the rotation of said articles for inspection, for advancing the push-rod means along said carriage means to advance the inspected group of articles into the packaging station for packaging, and thereafter for pivoting said push-rod means out of said trough means and returning the same along said carriage means in preparation for advancement of a further group of articles from said inspection station to said packaging station.

5. Apparatus according to claim 3 wherein said carriage means comprises an elongate cylinder member which extends generally in parallel to said trough means at said inspection station, and yoke means movable by said cylinder means bidirectionally along the length thereof for mounting said push-rod means.

6. Apparatus according to claim 5 wherein said pivotal mounting means mounts said cylinder for pivotal motion relative to said trough means for pivoting said push-rod means into and out of said trough means, and further including a piston-and-cylinder mounted for pivoting said cylinder about said pivotal mounting means to a degree necessary to cause the push-rod means to enter and leave said trough means.

7. Apparatus according to claim 1 wherein said rotating means comprise a pair of elongate rollers having article-contacting surfaces of an elastomeric material, bearing block means rotatably mounting said rollers and which are radially movable with respect to the axis of rotation thereof for permitting the advancing or retracting of the rollers relative to said trough means, motor means and drive means connecting said motor means for rotating said rollers in unison.

8. Apparatus according to claim 7, wherein said drive means includes flexible connector means for permitting the desired degree of radial movement of said rollers relative to said trough means while maintaining a drive connection between the motor means and the rotating.

9. Apparatus according to claim 7 and further including piston-and-cylinder means for advancing and retracting said rollers relative to said trough means.

10. Article handling apparatus for handling articles such as can ends, said apparatus being capable of receiving a continuous flow of articles and automatically counting and separating out a group of said articles of a predetermined number in a nested condition for delivery to a packaging station said apparatus comprising: elongate trough means extending along said apparatus from a receiving end thereof to a packaging station at an opposite end thereof for handling a flow of said articles in said stacked, nested condition; counting means for counting the number of articles passing a predesignated location along said trough means and following said receiving end thereof; separating means for separating a stack of articles of prescribed number, which number of articles has been counted by said counting means, and for advancing said group to an inspection station; rotating means at said inspection station for rotating said group of articles for visual inspection thereof; transport means for engaging said articles in said inspection station following the rotation and inspection thereof, and for advancing said group of articles to said packaging station; and control means operatively coupled with said separating means, said rotating means and said transport means for controlling predetermined sequence of operation thereof, wherein said articles are, in sequence, automatically counted, separated, inspected and transported to said packaging station in groups of nested articles of said predetermined number in an automated and continuously repeating fashion, such that as one group of said article is advanced to said packaging station, a following group is advanced to said inspection station and a further following group is being counted at the counting station.

11. An improvement in an article handling apparatus capable of receiving a continuous flow of articles such as can ends and automatically counting and separating a stack of articles of a prescribed number disposed in a facewise stacked relation for delivery to a packing station said apparatus comprising an elongate trough for handling a plurality of can ends in said stacked, facewise engagement, means for counting the number of can ends passing a predesignated location up to said predetermined number, and means for separating said predetermined number from said flow of articles upon the counting thereof and transporting the articles from said counting station, wherein the improvement comprises: an inspection station located between said counting station and said packing station, and including rotating means for rotating said articles to permit visual inspection thereof, and transport means for transporting said articles, following said visual inspection thereof, from said inspection station to said packing station.

* * * * *

UNITED STATES PATENT AND TRADEMARK OFFICE

CERTIFICATE OF CORRECTION

PATENT NO. : 5,005,340

DATED : April 9, 1991

INVENTOR(S) : Andrew E. Mojden

It is certified that error appears in the above-identified patent and that said Letters Patent is hereby corrected as shown below:

Column 4, Line 60 "operation means" it should be — operating means —

Column 7, Line 33 " and the rotating." it should be — and the rollers.—

Signed and Sealed this

Twenty-second Day of December, 1992

*Attest:*

DOUGLAS B. COMER

*Attesting Officer*

*Acting Commissioner of Patents and Trademarks*